US009303511B2

(12) United States Patent
Paros et al.

(10) Patent No.: US 9,303,511 B2
(45) **Date of Patent: *Apr. 5, 2016**

(54) FLAT CUTTER BIT WITH CUTTING INSERT HAVING EDGE PREPARATION

(71) Applicant: Kennametal Inc., Latrobe, PA (US)

(72) Inventors: Nicholas J. Paros, Johnstown, PA (US); Stephen M. George, Greensboro, NC (US); Glenn W. Sheffler, Blairsville, PA (US); Don C. Rowlett, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/871,023

(22) Filed: Apr. 26, 2013

(65) Prior Publication Data

US 2014/0319897 A1 Oct. 30, 2014

(51) Int. Cl.

| | |
|---|---|
| ***E21C 35/183*** | (2006.01) |
| ***E21B 10/58*** | (2006.01) |
| *E21C 35/18* | (2006.01) |

(52) U.S. Cl.

CPC ..... *E21C 35/183* (2013.01); *E21B 10/58* (2013.01); *E21C 2035/1816* (2013.01)

(58) Field of Classification Search

CPC ..... E21B 10/58; E21C 2035/1816; E21C 35/1936

USPC ..... 299/101, 102, 103, 108, 109, 111, 299/112 R, 112 T, 113, 79.1, 85.2, 100; 175/430

See application file for complete search history.

(56) References Cited

U.S. PATENT DOCUMENTS

| | | | | | |
|---|---|---|---|---|---|
| 2,689,108 | A | | 9/1954 | Haglund | |
| 2,740,611 | A | | 4/1956 | Bowen | |
| 3,006,424 | A | | 10/1961 | Dahlin et al. | |
| 3,671,075 | A | * | 6/1972 | Eyre et al. | 299/112 R |
| 4,026,372 | A | | 5/1977 | Hampson | |
| 4,120,601 | A | | 10/1978 | Benjamin | |
| 4,143,920 | A | * | 3/1979 | Haddock | 299/112 R |
| 4,189,013 | A | | 2/1980 | Adams et al. | |
| 4,194,790 | A | | 3/1980 | Kenny et al. | |
| 4,449,864 | A | | 5/1984 | Haque et al. | |
| 4,550,791 | A | | 11/1985 | Isakov | |
| 4,603,751 | A | | 8/1986 | Erickson | |
| 4,616,963 | A | | 10/1986 | Habert et al. | |

(Continued)

FOREIGN PATENT DOCUMENTS

| | | | |
|---|---|---|---|
| DE | 2619335 | | 11/1977 |
| DE | DT2618335 | A1 * | 11/1977 |

(Continued)

*Primary Examiner* — David Bagnell
*Assistant Examiner* — Michael Goodwin
(74) *Attorney, Agent, or Firm* — Larry R. Meenan

(57) ABSTRACT

A flat cutter bit for engaging an earth strata material includes a non-rotatable shank portion, a head portion integrally formed with the non-rotatable shank portion and including a tip region distal from the non-rotatable shank portion, and a cutting insert mounted at the tip region of the head portion. The cutting insert includes a body having an angled leading face, a top surface having a relief surface, a T-land surface extending between the angled leading face and the relief surface of the top surface and a cutting edge formed at the intersection of the T-land surface and the relief surface of the top surface.

16 Claims, 4 Drawing Sheets

(56) References Cited

U.S. PATENT DOCUMENTS

| | | | | |
|---|---|---|---|---|
| 4,667,755 | A | 5/1987 | Muller et al. | |
| 4,674,802 | A | 6/1987 | McKenna et al. | |
| 4,678,237 | A * | 7/1987 | Collin | 299/112 R |
| 4,787,464 | A | 11/1988 | Ojanen | |
| 4,817,742 | A | 4/1989 | Whysong | |
| 4,838,366 | A | 6/1989 | Jones | |
| 4,903,609 | A | 2/1990 | Isakov et al. | |
| 4,913,125 | A * | 4/1990 | Bunting et al. | 125/43 |
| 4,984,944 | A | 1/1991 | Pennington, Jr. et al. | |
| 4,998,574 | A | 3/1991 | Beach et al. | |
| 5,141,367 | A | 8/1992 | Beeghly et al. | |
| 5,147,158 | A | 9/1992 | Riviere | |
| 5,172,775 | A | 12/1992 | Sheirer et al. | |
| 5,184,689 | A | 2/1993 | Sheirer et al. | |
| 5,220,967 | A | 6/1993 | Monyak | |
| 5,297,853 | A | 3/1994 | Sollami | |
| 5,319,855 | A * | 6/1994 | Beevers et al. | 30/308.1 |
| 5,375,672 | A | 12/1994 | Peay et al. | |
| 5,400,861 | A | 3/1995 | Sheirer | |
| 5,452,628 | A | 9/1995 | Montgomery, Jr. et al. | |
| 5,467,837 | A | 11/1995 | Miller et al. | |
| 5,482,124 | A | 1/1996 | Haussmann et al. | |
| 5,996,715 | A | 12/1999 | Peay et al. | |
| 6,053,263 | A * | 4/2000 | Meiners | 175/331 |
| 6,145,606 | A | 11/2000 | Haga | |
| 6,173,798 | B1 | 1/2001 | Bryant et al. | |
| 6,174,111 | B1 | 1/2001 | Anjanappa et al. | |
| 6,260,637 | B1 | 7/2001 | Haussmann et al. | |
| 6,260,638 | B1 | 7/2001 | Massa et al. | |
| 6,270,164 | B1 * | 8/2001 | Seitle et al. | 299/82.1 |
| 6,270,297 | B1 | 8/2001 | Fang et al. | |
| 6,446,741 | B1 | 9/2002 | Kersten et al. | |
| 6,595,305 | B1 | 7/2003 | Dunn et al. | |
| 6,860,344 | B2 | 3/2005 | Bise et al. | |
| 6,945,340 | B2 | 9/2005 | Bise et al. | |
| 6,976,549 | B2 | 12/2005 | Haussmann et al. | |
| 7,001,120 | B2 | 2/2006 | Moser et al. | |
| 7,168,511 | B2 | 1/2007 | Woods et al. | |
| 7,393,061 | B2 * | 7/2008 | Hesse et al. | 299/112 R |
| 7,401,667 | B2 | 7/2008 | Duscha et al. | |
| 7,455,129 | B2 | 11/2008 | Widmann et al. | |
| 7,578,080 | B2 * | 8/2009 | Stoetzer et al. | 37/452 |
| 8,002,054 | B2 | 8/2011 | Swope et al. | |
| 8,020,591 | B2 | 9/2011 | Kappel et al. | |
| 8,136,887 | B2 * | 3/2012 | Hall et al. | 299/113 |
| 8,789,894 | B2 | 7/2014 | Lucek et al. | |
| 9,085,947 | B2 | 7/2015 | George et al. | |
| 2003/0077134 | A1 | 4/2003 | Moser et al. | |
| 2003/0159855 | A1 | 8/2003 | Haussmann et al. | |
| 2004/0089481 | A1 | 5/2004 | Bise et al. | |
| 2006/0065446 | A1 | 3/2006 | Woods et al. | |
| 2007/0151769 | A1 * | 7/2007 | Slutz et al. | 175/426 |
| 2007/0169965 | A1 | 7/2007 | Moser et al. | |
| 2010/0187019 | A1 | 7/2010 | Swope et al. | |
| 2010/0316456 | A1 | 12/2010 | George | |
| 2012/0241223 | A1 | 9/2012 | Bise et al. | |
| 2014/0318870 | A1 | 10/2014 | George et al. | |
| 2014/0318871 | A1 | 10/2014 | Paros et al. | |
| 2014/0318872 | A1 | 10/2014 | Paros et al. | |

FOREIGN PATENT DOCUMENTS

| | | |
|---|---|---|
| DE | 3315624 | 11/1984 |
| DE | 19514454 | 10/1996 |
| DE | 202010005228 | 10/2011 |

* cited by examiner

FLAT CUTTER BIT WITH CUTTING INSERT HAVING EDGE PREPARATION

BACKGROUND OF THE INVENTION

The invention pertains generally to an excavating tool such as, for example, a cutter bit useful for cutting through various earth strata and other materials. More specifically, the invention pertains to a flat cutter bit with a cutting insert having edge preparation.

Various types of cutting assemblies having cutter bits are used for mining, construction and related operations wherein, typically, the cutter bits include a shank for insertion into a tool holder and a forward working portion on the shank for engagement with earth strata, e.g., coal, or mineral formation or other natural materials or the like. An individual insert formed of a hard, wear resistant material is provided on the forward working portion to cut into the earth strata and to enhance the life of the cutter bit as it removes the material.

An example of a cutting assembly having cutter bits that are used for mining and construction operations include a flat cutter tool. These types of cutting tools usually include a plurality of cutter bits mounted on a rotatable disc, rake, chain, barrel or drum, wherein each of the cutter bits include a substantially-flat cutting insert made of a hard material. These substantially-flat cutting inserts are affixed to the forward working end of the cutter bits. However, it has been determined that due to the shape and configuration of the substantially-flat cutter inserts, the cutter inserts do not wear uniformly. This non-uniform wear decreases the overall useful life of the cutting inserts. More particularly, the cutting edge of the substantially-flat cutter inserts have a tendency to chip or break during use due to the shape of the cutting edge.

Accordingly, it would be desirable to provide improved cutting tools that overcome limitations and disadvantages of known such tools. In addition, it would be desirable to provide improved cutter bits that overcome limitations and disadvantages of known cutter bits and that provide for improved wear and efficiency during operation. Furthermore, it would be desirable to provide improved cutting inserts for cutter bits that overcome limitations and disadvantages of known cutting inserts and that provide for improved wear and efficiency during operation.

SUMMARY OF THE INVENTION

In accordance with another aspect of the invention, a flat cutter bit for engaging, for example, an earth strata material includes a non-rotatable shank portion, a head portion integrally formed with the non-rotatable shank portion and including a tip region distal from the non-rotatable shank portion, and a cutting insert mounted at the tip region of the head portion. The cutting insert includes a body having an angled leading face, a top surface having a relief surface, a T-land surface extending between the angled leading face and the relief surface of the top surface and a cutting edge formed at the intersection of the T-land surface and the relief surface of the top surface.

In accordance with yet another aspect of the invention, a cutting insert for use in connection with a cutter bit for engaging, for example, an earth strata material includes a body having an angled leading face, a top surface having a relief surface, a T-land surface extending between the angled leading face and the relief surface of the top surface and a cutting edge formed at the intersection of the T-land surface and the relief surface of the top surface.

These and other aspects of the present invention will be more fully understood following a review of this specification and drawings.

DETAILED DESCRIPTION

Figure 1:
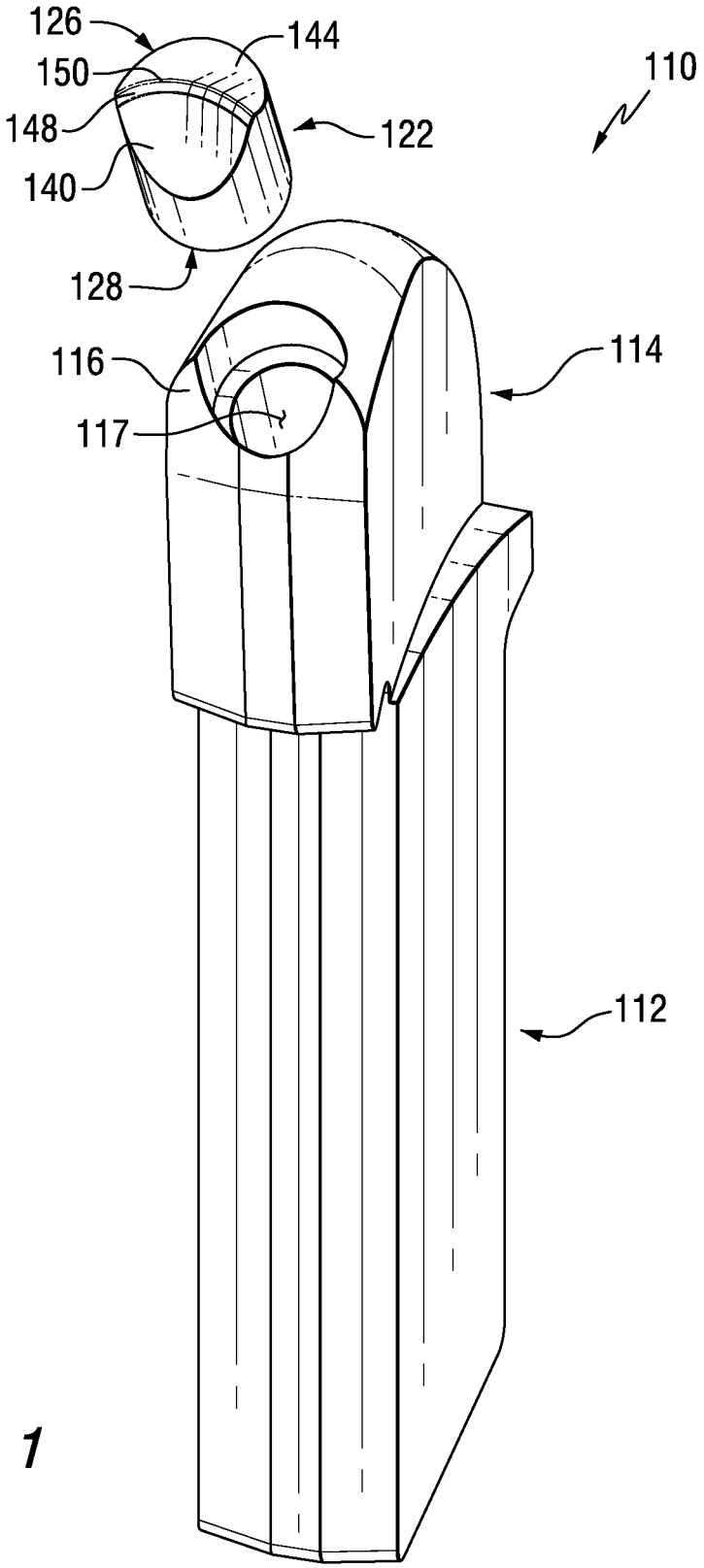
FIG. 1 is an exploded isometric view of a cutter bit, e.g. a flat cutter bit, in accordance with an aspect of the invention.
Figure 3:
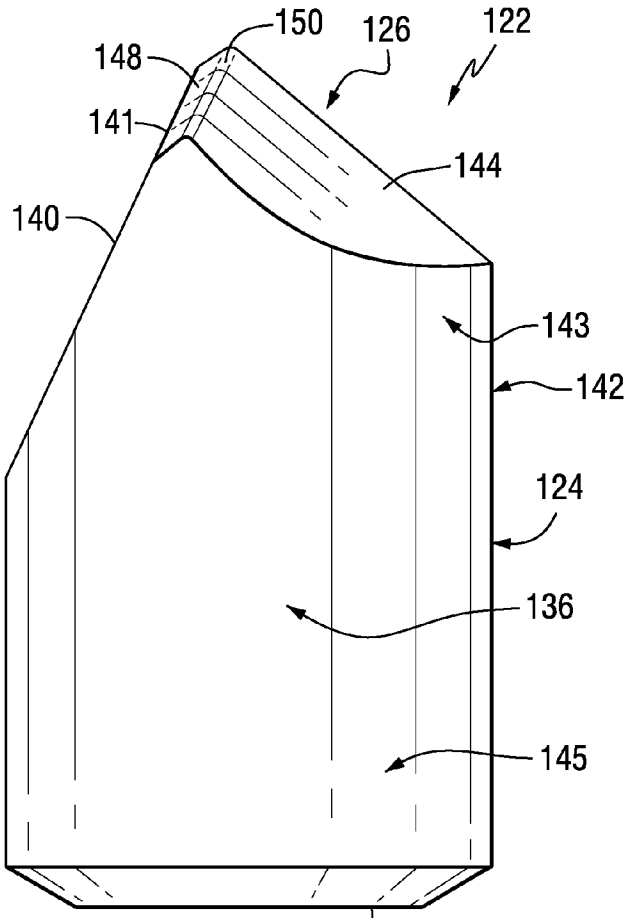
FIG. 3 is a side view of the cutting insert shown in FIG. 2, in accordance with an aspect of the invention.

The following description is for purposes of illustrating various aspects of the invention only and not for purposes of limiting the scope of the invention.

Referring to FIGS. 1-4, there is illustrated a cutter bit in the form of, for example, a flat cutter bit generally designated as 110, and a cutting insert generally designated as 122 for use therewith. The flat cutter bit 110 includes a shank portion 112 that is non-rotatable, i.e. the shank portion 112 does not rotate during operation once the flat cutter bit 110 is assembled by inserting the shank portion 112 of the flat cutter bit 110 into a tool holder base (not shown). In one aspect, the shank portion 112 has a generally non-circular cross-section, e.g. a generally rectangular cross-section.

The flat cutter bit 110 includes a forward working end that includes a head portion 114 integrally formed with the shank portion 112 and having a tip region 116 distal from the shank portion 112. The cutting insert 122 is mounted at the tip region 116 of the head portion 114. The cutting insert 122 is typically mounted or affixed to or within a socket 117 defined at the tip region 116 of the head portion 114 by, for example, attaching mechanically or otherwise, via brazing, gluing, or press fitting using conventional compositions and techniques known to those skilled in the art.

The cutting insert 122 is made from, for example, a cemented tungsten carbide that is a mixture of cobalt and tungsten carbide. Other super hard, wear resistant materials such as polycrystalline diamond, ceramics, or cermet may be used as a supplement and/or substitute. For example chromium carbide-coated metals and other cermets where titanium carbide or vanadium carbide is added to tungsten carbide may be candidates for inserts materials in accordance to aspects of the invention. Alternate ceramics for such applications include aluminum-based, silicon based, zirconium-based and glass varieties. Still other insert materials alternatives include cubic refractory, transition metal carbides or any other known or subsequently developed material(s) harder than the base material. Also coatings of the inserts such as PVD or CVD coatings can be used.

In one aspect, the cutting insert 122 is made, for example, with a powder metallurgy process using a press comprising of a die and top and bottom ram/punch to press the complete shape. Parts can be pressed to finished shape or modified with a wet/dry blast, or diamond ground other material shaping processes such as but not limited to EDM (electrical discharge machining), EDG (electrical discharge grinding), green machining, laser ablation into final shapes. Advantageously, the invention provides for moving the critical cutting edge of the insert from the intersection of the die case and ram during manufacturing. In accordance with an aspect of the invention, the critical cutting edge is now formed entirely in the ram/punch. This eliminates the flash from forming on the cutting edge. Flash is undesirable because, for example, it is a stress concentrator. It will be appreciated that these and other aspects of the invention as set forth herein contribute to the desired edge, i.e. cutting edge, preparation for the cutting insert.

Cutting insert 122 has a cutting insert body, generally designated as 124, that has a top surface 126, a bottom surface 128, a first side portion 134 and a second side portion 136. The cutting insert body 124 also includes an angled or sloped leading face 140 and an opposite rearward or trailing side portion 142. In one aspect, the angled leading face 140 is generally planar and is generally located on an upper section 143 of the body 124. In another aspect, the body 124 also includes a lower section 145 that has a generally circular cross-sectional shape or configuration.

The top surface 126 of the cutting insert 122 includes a relief surface 144. In one aspect, the relief surface 144 extends toward the rearward or trailing side portion 142 of the cutting insert 122. In another aspect, the relief surface 144 extends to the rearward or trailing side portion 142.

In accordance with another aspect of the invention, the cutting insert 122 includes edge preparation such as a T-land surface, generally designated as 148, extending generally between at least a portion of the angled leading face 140 and the relief surface 144 of the top surface 126. In one aspect, the T-land surface 148 extends between the length of the angled leading face 140 and the relief surface 144. In another aspect, the T-land 148 is contiguous with the angled leading face 140. In yet another aspect, the T-land 148 is contiguous with the relief surface 144. It will be appreciated that the T-land surface 148 may be a planar surface or other than a planar surface, such as, for example it may include a rounded or curved, i.e. non-planar, T-land surface.

The cutting insert 122 further includes a cutting edge 150 formed at the intersection of the T-land surface 148 and the relief surface 144 of the top surface 126. In one aspect, the cutting edge 150 is rounded. In another aspect, the angled leading face 140 and the T-land 148 intersect to form a rounded leading edge 141.

Figure 2:
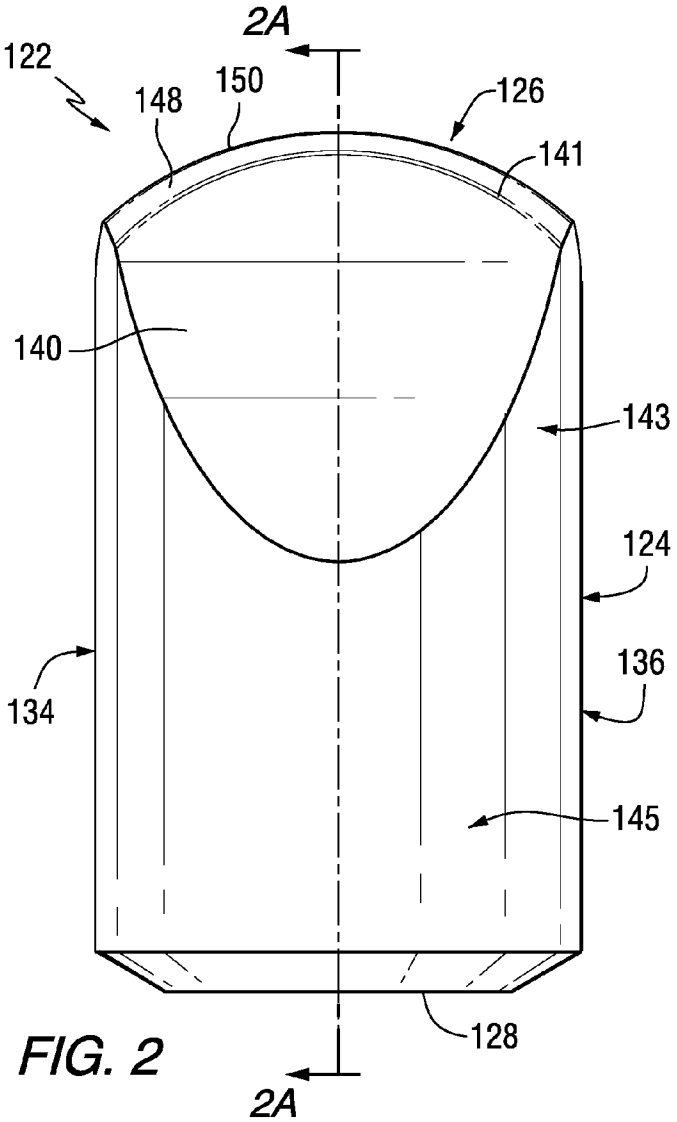
FIG. 2 is a front view of a cutting insert for use with the cutter bit shown in FIG. 1, in accordance with an aspect of the invention.
Figure 2A:
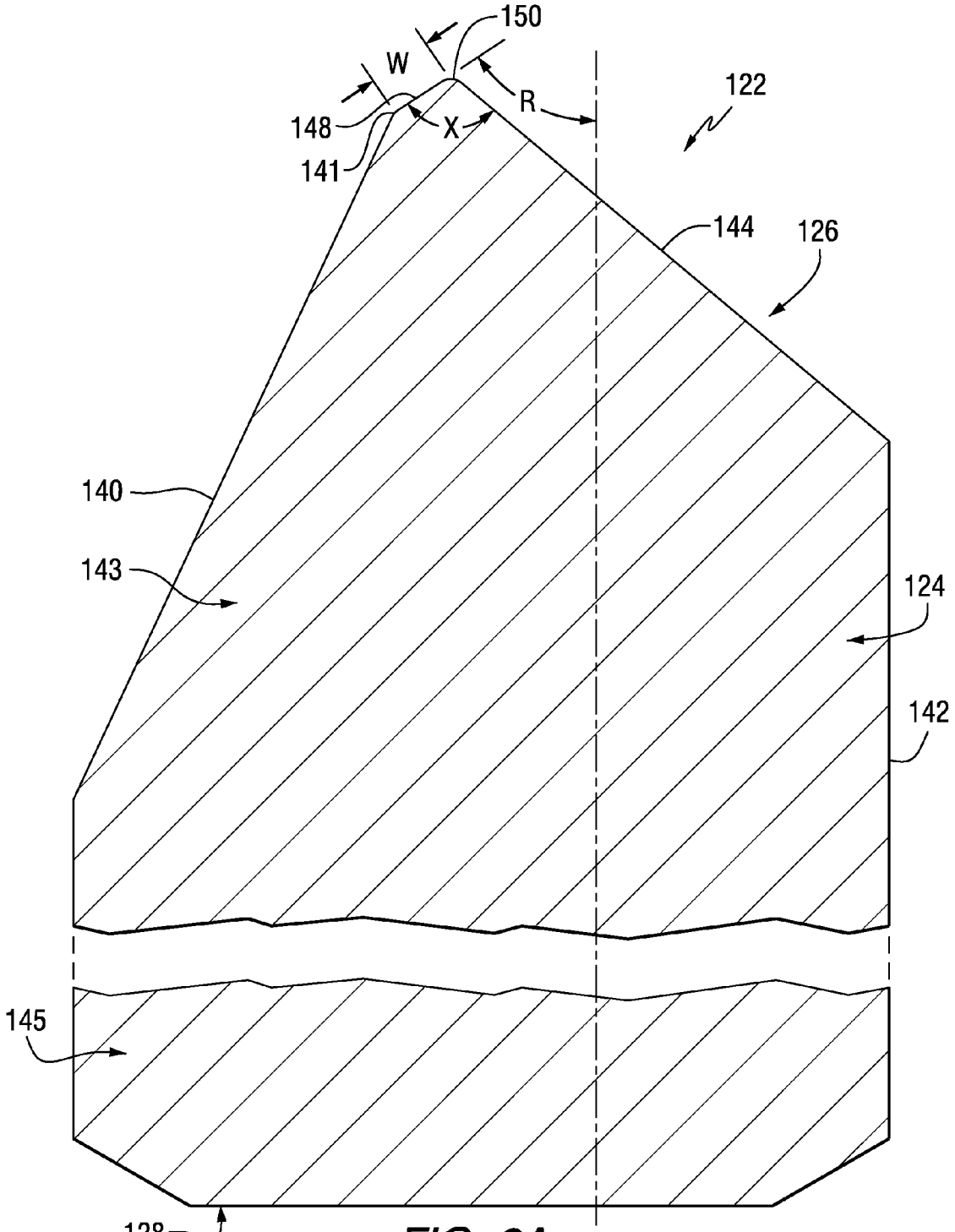
FIG. 2A is a sectional view taken along line 2A-2A of FIG. 2, in accordance with another aspect of the invention.
Figure 4:
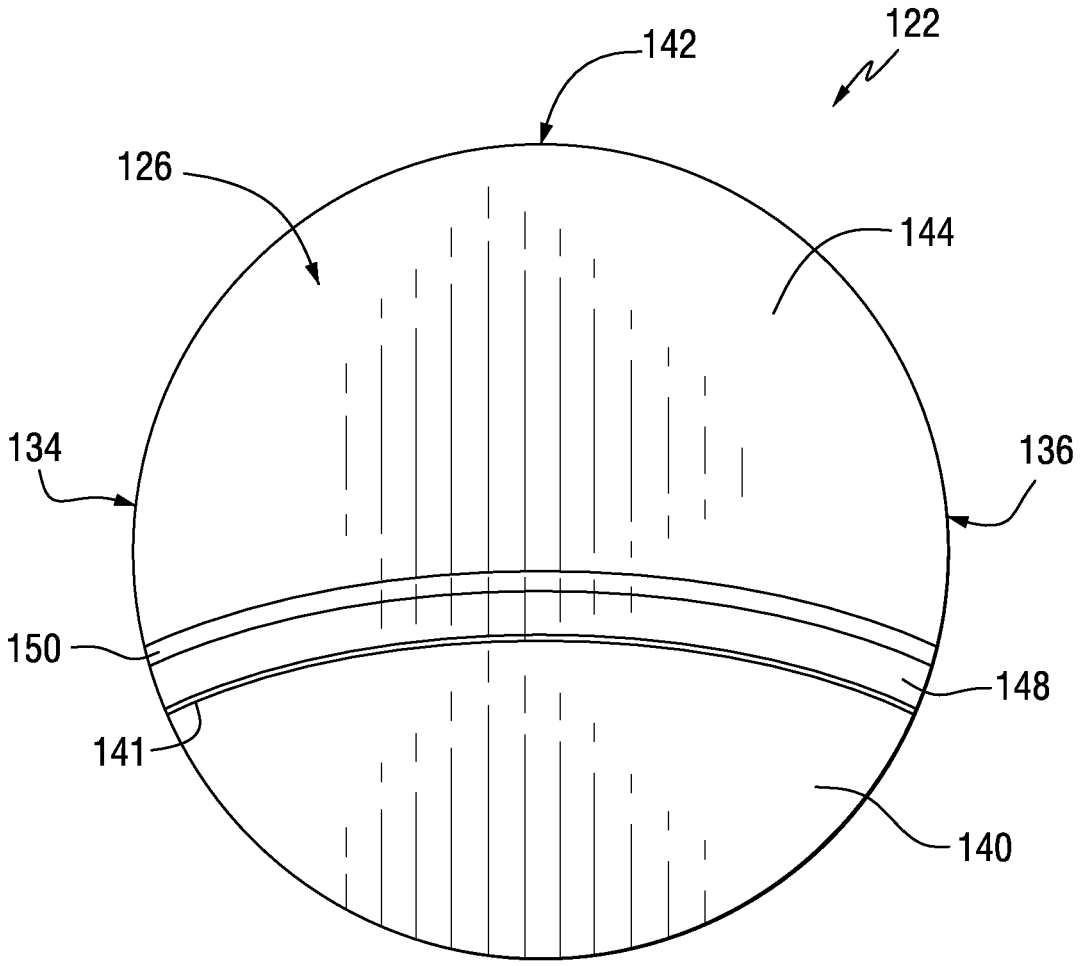
FIG. 4 is a top view of the cutting insert shown in FIGS. 2 and 3, in accordance with an aspect of the invention.

The configuration of having the cutting edge 150 formed at the intersection of the T-land surface 148 and the relief surface 144 provides for the cutting edge 150 to have a negative axial rake angle R (see, for example, FIG. 2A). In one aspect, the negative axial rake angle R is in the range of about 10 degrees to about 60 degrees. In one specific example, the rake angle R shown in FIG. 2A is about negative 55 degrees.

The T-land surface 148 is positioned relative to the relief surface 144 at an angle X (see, for example, FIG. 2A). The angle X may be referred to as a relief angle relative to or in relation to cutting edge 150. In one aspect, the T-land surface 148 is positioned relative to the relief surface 144 at an angle X that is greater than 90 degrees. In one specific example, the angle X shown in FIG. 2A is about 115 degrees.

In another aspect, the T-land surface 148 may have a width W (see, for example, FIG. 2A) in the range of about 0.002 inches to about 0.090 inches. In one specific example, the width W is about 0.020 inches.

It will be appreciated that the configuration of the T-land 148, cutting edge 150, negative axial rake angle R and/or the relief angle X individually and/or in combination advantageously avoid a sharp transition for the cutting edge 150 so as to reduce or minimize the possibility of the cutting edge 150 breaking or chipping during operation of the cutter bit 110. In addition, the T-land 148 is configured so as to redirect the cutting forces along the cutting edge 150 to reduce the shear stress along the cutting edge 150.

Whereas particular aspects of this invention have been described above for purposes of illustration, it will be evident to those skilled in the art that numerous variations of the details of the present invention may be made without departing from the invention as defined in the appended claims.

What is claimed is:

1. A flat cutter bit, the flat cutter bit comprising:
- a non-rotatable shank portion;
- a head portion integrally formed with the non-rotatable shank portion and including a tip region distal from the non-rotatable shank portion; and
- a cutting insert mounted at the tip region of the head portion, wherein the cutting insert comprises:
  - a body having an angled leading face, wherein the angled leading face is planar;
  - wherein the body further includes a top surface having a relief surface, a bottom surface, a first side portion and a second side portion;
  - an arcuate T-land surface extending between the angled leading face and the relief surface of the top surface, wherein the arcuate T-land is contiguous with the angled leading face; and
  - an arcuate cutting edge formed only at the intersection of the arcuate T-land surface and the relief surface of the top surface,
  - wherein the arcuate T-land surface and the arcuate cutting edge extend continuously from the first side portion to the second side portion of the body.

2. The flat cutter bit of claim 1, wherein the arcuate cutting edge has a negative axial rake angle.

3. The flat cutter bit of claim 2, wherein the negative axial rake angle is in the range of about 10 degrees to about 60 degrees.

4. The flat cutter bit of claim 2, wherein the arcuate T-land surface is positioned relative to the relief surface of the top surface at an angle that is greater than 90 degrees.

5. The flat cutter bit of claim 1, wherein the arcuate cutting edge is rounded where the arcuate T-land surface intersects with the relief surface.

6. The flat cutter bit of claim 1, wherein the arcuate T-land surface has a width in the range of about 0.002 inches to about 0.090 inches.

7. The flat cutter bit of claim 1, wherein the angled leading face is on an upper section of the body.

8. The flat cutter bit of claim 7, wherein the body also includes a lower section that has a generally circular cross-sectional shape.

9. A cutting insert for use in connection with a cutter bit, the cutting insert comprising:
- a body having an angled leading face, wherein the angled leading face is planar;
- wherein the body further includes a top surface having a relief surface, a bottom surface, a first side portion and a second side portion;
- an arcuate T-land surface extending between the angled leading face and the relief surface of the top surface, wherein the arcuate T-land is contiguous with the angled leading face; and
- an arcuate cutting edge formed only at the intersection of the arcuate T-land surface and the relief surface of the top surface,
- wherein the arcuate T-land surface and the arcuate cutting edge extend continuously from the first side portion to the second side portion of the body.

10. The cutting insert of claim 9, wherein the arcuate cutting edge has a negative axial rake angle.

11. The cutting insert of claim 10, wherein the negative axial rake angle is in the range of about 10 degrees to about 60 degrees.

12. The cutting insert of claim 10, wherein the arcuate T-land surface is positioned relative to the relief surface of the top surface at an angle that is greater than 90 degrees.

13. The cutting insert of claim 9, wherein the arcuate cutting edge is rounded where the arcuate T-land surface intersects with the relief surface.

14. The cutting insert of claim 9, wherein the arcuate T-land surface has a width in the range of about 0.002 inches to about 0.090 inches.

15. The cutting insert of claim 9, wherein the angled leading face is on an upper section of the body.

16. The cutting insert of claim 15, wherein the body also includes a lower section that has a generally circular cross-sectional shape.

* * * * *